US010208500B2

(12) United States Patent
Jin

(10) Patent No.: US 10,208,500 B2
(45) Date of Patent: Feb. 19, 2019

(54) ILLUMINATION TENT POLE AND TENT FRAME HAVING SAME

(71) Applicant: Xiamen Innovation Metal Products Co., Ltd., Xiamen (CN)

(72) Inventor: Juyoung Jin, Xiamen (CN)

(73) Assignee: Xiamen Innovation Metal Products Co., LTD., Xiamen (CN)

( * ) Notice: Subject to any disclaimer, the term of this patent is extended or adjusted under 35 U.S.C. 154(b) by 0 days.

(21) Appl. No.: 15/482,622

(22) Filed: Apr. 7, 2017

(65) Prior Publication Data

US 2017/0292285 A1 Oct. 12, 2017

(30) Foreign Application Priority Data

Apr. 7, 2016 (CN) ..... 2016 2 0282745 U

(51) Int. Cl.

| | |
|---|---|
| ***E04H 15/10*** | (2006.01) |
| ***F21S 4/28*** | (2016.01) |
| ***E04H 15/02*** | (2006.01) |
| ***E04H 15/46*** | (2006.01) |
| ***E04H 15/54*** | (2006.01) |
| ***E04H 15/60*** | (2006.01) |

(Continued)

(52) U.S. Cl.

CPC ..... *E04H 15/10* (2013.01); *E04H 15/02* (2013.01); *E04H 15/46* (2013.01); *E04H 15/54* (2013.01); *E04H 15/60* (2013.01); *F21S 4/28* (2016.01); *F21V 23/04* (2013.01); *F21V 23/06* (2013.01); *E04H 2015/326* (2013.01); *F21S 4/20* (2016.01); *F21S 4/24* (2016.01); *F21V 21/00* (2013.01); *F21Y 2103/10* (2016.08); *F21Y 2113/10* (2016.08); *F21Y 2115/10* (2016.08)

(58) Field of Classification Search

CPC ..... E04H 15/10; E04H 15/50

See application file for complete search history.

(56) References Cited

U.S. PATENT DOCUMENTS

| | | | |
|---|---|---|---|
| 4,817,044 | A | 3/1989 | Ogren |
| 6,089,727 | A | 7/2000 | Wu |

(Continued)

FOREIGN PATENT DOCUMENTS

| | | | |
|---|---|---|---|
| CN | 200949757 | Y | 9/2007 |
| CN | 201924648 | U | 8/2011 |

(Continued)

*Primary Examiner* — Noah Chandler Hawk

(74) *Attorney, Agent, or Firm* — Morgan, Lewis & Bockius LLP

(57) ABSTRACT

Disclosed are illumination tent poles, tent frames and tents having one or more illumination tent poles. An illumination tent pole includes a tent pole, an elongated casing, a strip light source and a cover. The elongated casing is coupled to the tent pole or integrally formed with the tent pole. The elongated casing has an opening along a longitudinal direction of the elongated casing and facing away from the tent pole. The strip light source is disposed in the elongated casing along the longitudinal direction of the elongated casing. The strip light source emits a light when electrically connected to an electrical power source. The cover is coupled to the elongated casing and covers the opening of the elongated casing. The cover is made of a material that is at least partially transparent to the light emitted by the strip light source.

28 Claims, 8 Drawing Sheets

(51) Int. Cl.

| | |
|---|---|
| ***F21V 23/04*** | (2006.01) |
| ***F21V 23/06*** | (2006.01) |
| *F21Y 103/10* | (2016.01) |
| *F21Y 115/10* | (2016.01) |
| *E04H 15/32* | (2006.01) |
| *F21V 21/00* | (2006.01) |
| *F21S 4/20* | (2016.01) |
| *F21S 4/24* | (2016.01) |
| *F21Y 113/10* | (2016.01) |

(56) References Cited

U.S. PATENT DOCUMENTS

| | | | | |
|---|---|---|---|---|
| 6,439,249 | B1 | 8/2002 | Pan | |
| 6,773,140 | B2 | 8/2004 | Lee | |
| 7,311,113 | B2 * | 12/2007 | Suh | E04H 15/48 135/131 |
| 7,455,427 | B1 | 11/2008 | Freeman | |
| 7,562,667 | B2 | 7/2009 | Li | |
| 2003/0084931 | A1 | 5/2003 | Lee | |
| 2008/0000513 | A1 | 1/2008 | Lee | |
| 2008/0029141 | A1 | 2/2008 | Grand | |
| 2008/0072945 | A1 | 3/2008 | Grand Pre | |
| 2013/0271966 | A1 | 10/2013 | Doble | |
| 2015/0034137 | A1 | 2/2015 | Tanaeim | |
| 2017/0292285 | A1 | 10/2017 | Jin | |

FOREIGN PATENT DOCUMENTS

| | | | |
|---|---|---|---|
| CN | 203684790 | U | 7/2014 |
| CN | 204492319 | U | 7/2015 |
| CN | 204627108 | U | 9/2015 |
| CN | 204691386 | U | 10/2015 |
| CN | 205025192 | U | 2/2016 |
| CN | 205591637 | U | 9/2016 |
| CN | 205743243 | U | 11/2016 |
| CN | 205840492 | U | 12/2016 |
| CN | 206035078 | U | 3/2017 |
| CN | 206035080 | U | 3/2017 |
| WO | WO 2012/088973 | A1 | 7/2012 |
| WO | WO 2015/183926 | A1 | 12/2015 |

* cited by examiner

ILLUMINATION TENT POLE AND TENT FRAME HAVING SAME

CROSS-REFERENCE TO RELATED APPLICATIONS

The present application claims priority to Chinese Utility Model Application CN 201620282745.6 filed Apr. 7, 2016. The disclosure of the application is incorporated herein for all purposes by reference in its entirety.

FIELD OF THE INVENTION

The present invention generally relates to tent poles, tent frames and tents, and more particularly, relates to illumination tent poles, and tent frames and tents having such illumination tent poles.

BACKGROUND

Many existing tents do not have illumination means. When illumination is desired, detached lights are used. Such a detach light is usually placed inside of the tent and in most cases is hung at the top of the tent. As such, it reduces the usable interior space of the tent. In addition, as it is a separate component from the tent, it is easy to get lost or left behind.

Given the current state of the art, there remains a need for tent frames and tents that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present invention provides tent frames and tents that include one or more illumination tent poles and are convenient to use.

In various exemplary embodiments, the present invention provides an illumination tent pole including a tent pole, an elongated casing, a strip light source and a cover. The elongated casing is coupled to the tent pole or integrally formed with the tent pole. The elongated casing has an opening along a longitudinal direction of the elongated casing. The opening faces away from the tent pole, and in some cases, the opening is opposite to the tent pole.

The strip light source is disposed in the elongated casing along the longitudinal direction of the elongated casing. The strip light source emits a light when electrically connected to an electrical power source. In some exemplary embodiments, the strip light source is a light emitting diode (LED) strip, an LED tape, or an LED ribbon.

The cover is coupled to the elongated casing and covers the opening of the elongated casing. The cover is made of a material that is at least partially transparent to the light emitted by the strip light source.

In some exemplary embodiments, the elongated casing is fastened or welded to a peripheral wall of the tent pole. In some exemplary embodiments, the elongated casing is formed with a fitting opposite to the opening of the elongated casing. The fitting is configured to be fitted onto the tent pole, thereby coupling the elongated casing with the tent pole. In an exemplary embodiment, the fitting is a C-shape snap fit. In some exemplary embodiments, the tent pole is formed with a receptacle along a longitudinal direction of the tent pole. The receptacle serves as the elongated casing. In an exemplary embodiment, the receptacle is recessed inwardly into the tent pole with the opening facing an outside of the tent pole.

In various exemplary embodiments, the present invention provides a tent frame including a first pole connector, a plurality of top poles, and a plurality of supporting poles. Each top pole in the plurality of top poles has a first end portion and a second end portion, with the first end portion pivotally connected to the first pole connector. The plurality of top poles includes one or more illumination tent poles of the present invention disclosed herein. In an exemplary embodiment, each top pole in the plurality of top poles is an illumination tent pole.

Each supporting pole in the plurality of supporting poles has a first end portion pivotally connected to the second end portion of a corresponding top pole in the plurality of top poles. In some exemplary embodiments, each top pole in the plurality of tent poles is pivotally connected to one or more supporting poles in the plurality of supporting poles. In some exemplary embodiments, the tent frame further include a plurality of second pole connectors, each pivotally connecting the second end portion of one top pole in the plurality of top poles with one or more supporting poles in the plurality of supporting poles.

In an exemplary embodiment, each of one or more supporting poles in the plurality of supporting poles is telescopic, or has a length that is adjustable. In some exemplary embodiments, each of one or more supporting poles in the plurality of supporting poles includes an upper supporting pole and a lower supporting pole. The upper supporting pole has first and second end portions, with the first end portion pivotally connected to the second end portion of a corresponding top pole in the plurality of top poles. The lower supporting pole has a first end portion pivotally coupled to the second end portion of the upper supporting pole, and a second end portion to be disposed at a ground. In an exemplary embodiment, the lower supporting pole is telescopic, or has a length that is adjustable.

In some exemplary embodiments, the tent frame further includes a power source and a first electrical connector. The power source is to supply electrical power to the strip light source of each illumination tent pole in the one or more illumination tent poles. The first electrical connector is to electrically connect the strip light source of each illumination tent pole in the one or more illumination tent poles with the power source.

In some exemplary embodiments, the tent frame further includes a switch to control the electrical power supplied to the strip light source of each illumination tent pole in the one or more illumination tent poles. The switch has a first terminal electrically connected to the power source and a second terminal electrically connected to the first electrical connector.

In some exemplary embodiments, the tent frame further includes a storage compartment to house the power source, the first electrical connector and the switch. The storage compartment is configured to be coupled to a tent cloth, the tent frame, or both of the tent cloth and the tent frame.

In some exemplary embodiments, the tent frame further includes a board disposed at the first pole connector. The board includes one or more second electrical connectors electrically connected to the first electrical connector or the power source. The strip light source of a respective illumination pole in the one or more illumination tent poles is electrically connected to a corresponding second electrical connector in the one or more second electrical connector. In an exemplary embodiment, the board is coupled to a bottom of the first pole connector.

In various exemplary embodiments, the present invention provides a tent including a tent frame of the present invention disclosed herein and a tent cloth coupled to and supported by the tent frame when the tent is unfolded.

The illumination tent poles, tent frames and tents of the present invention have other features and advantages that will be apparent from, or are set forth in more detail in, the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more exemplary embodiments of the present invention and, together with the Detailed Description, serve to explain the principles and implementations of exemplary embodiments of the invention.

DETAILED DESCRIPTION

Reference will now be made in detail to implementations of exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present invention are described in the context of illumination tent poles, and tents and tent frames having such illumination tent poles. Generally, an illumination tent pole of the present invention includes a tent pole, an elongated casing and a strip light source. The elongated casing is coupled to the tent pole (e.g., by welding, fastening or the like) or integrally formed with the tent pole. The strip light source is disposed in the elongated casing to provide illumination.

Tents and tent frames of the present invention can be of various sizes and shapes, including but not limited to gazebos, domes, shelters and other types of tents. Generally, a tent frame of the present invention includes one or more illumination tent poles of the present invention disclosed herein. The one or more illumination tent poles can be used, for example, as top tent poles or upper tent poles. When powered, the light sources of the one or more illumination tent poles provide desired illumination. The tent frames and the tents of the present invention are compact, easy to setup, and convenient to use.

Figure 1:
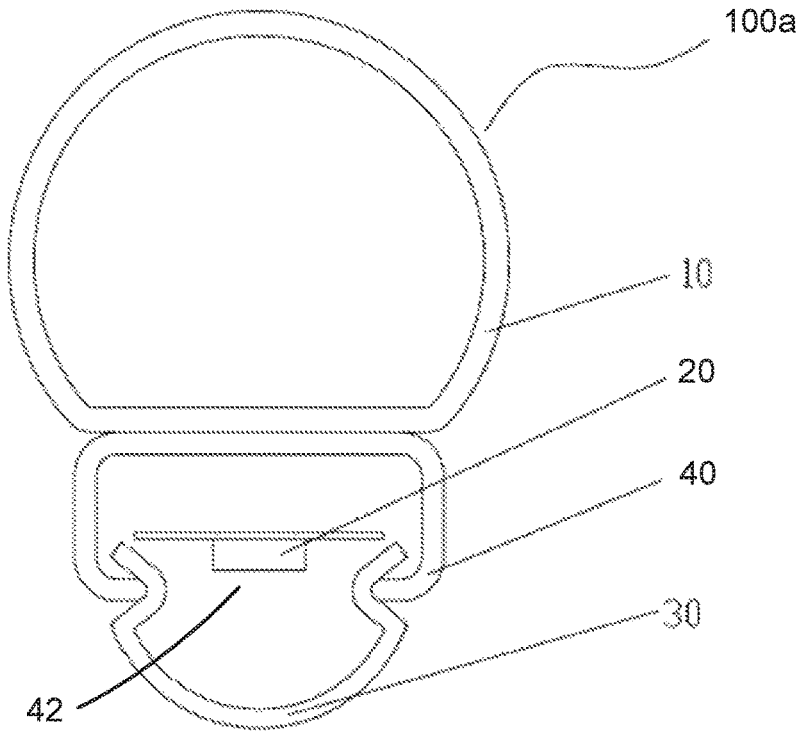
FIG. 1 is a schematic view illustrating a first exemplary illumination tent pole in accordance with some exemplary embodiments of the present invention.
Figure 2:
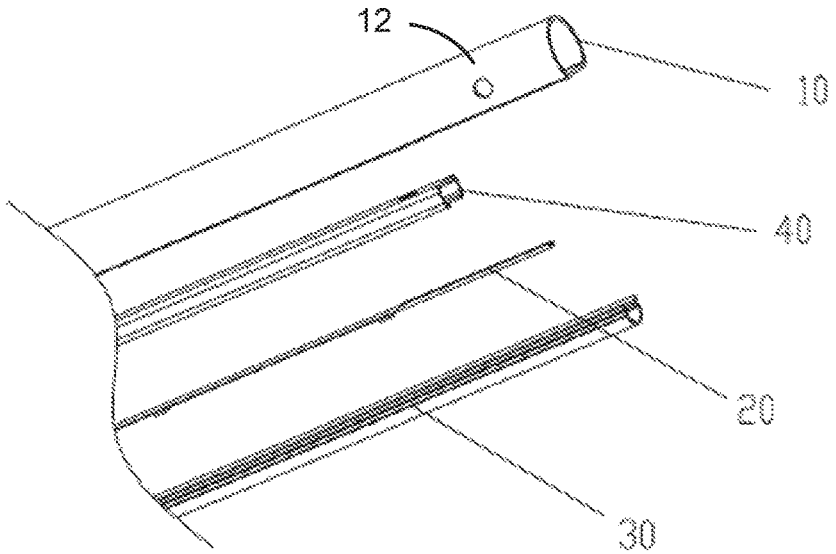
FIG. 2 is an exploded view illustrating the exemplary illumination tent pole of FIG. 1.

Referring to FIGS. 1 and 2, there is depicted a first exemplary illustrate illumination tent pole in accordance with some exemplary embodiments. As shown, tent pole 100*a* includes a tent pole such as tent pole 10, an elongated casing such as elongated casing 40, and a light source such as strip light source 20. Elongated casing 40 is attached to tent pole 10, for example, by welding, bolting or the like to a peripheral wall of the tent pole. In an exemplary embodiment, the elongated casing has a substantially C-shape cross section. In many exemplary embodiments, elongated casing 40 has an opening such as opening 42 formed along a longitudinal direction of the elongated casing. The opening faces away from the tent pole. In an exemplary embodiment, the opening is opposite to the wall of the tent pole at which the elongated casing is attached.

Strip light source 20 is disposed in elongated casing 40 along the longitudinal direction of the elongated casing, for example, being attached to an interior wall of elongated casing 40 by an adhesive or the like. The strip light source emits a light when connected to a power source. The emitted light is transmitted through the opening of the elongated casing to provide desired illumination. In various exemplary embodiments, the strip light source is a flexible circuit board such as a light-emitting diode (LED) strip, an LED tape or an LED ribbon. The LED strip, tape or ribbon can be of a single color or multiple colors.

In some embodiments, illumination tent pole 100*a* further includes a cover such as cover 30 coupled to the elongated casing and covering the opening of the elongated casing. In an exemplary embodiment, the cover is snap-fitted to the opening of the casing. The cover is made of a material that is at least partially transparent to the light emitted by the strip light source. As such, the light emitted by the strip light source is transmitted through the cover and provides illumination when desired.

Figure 3:
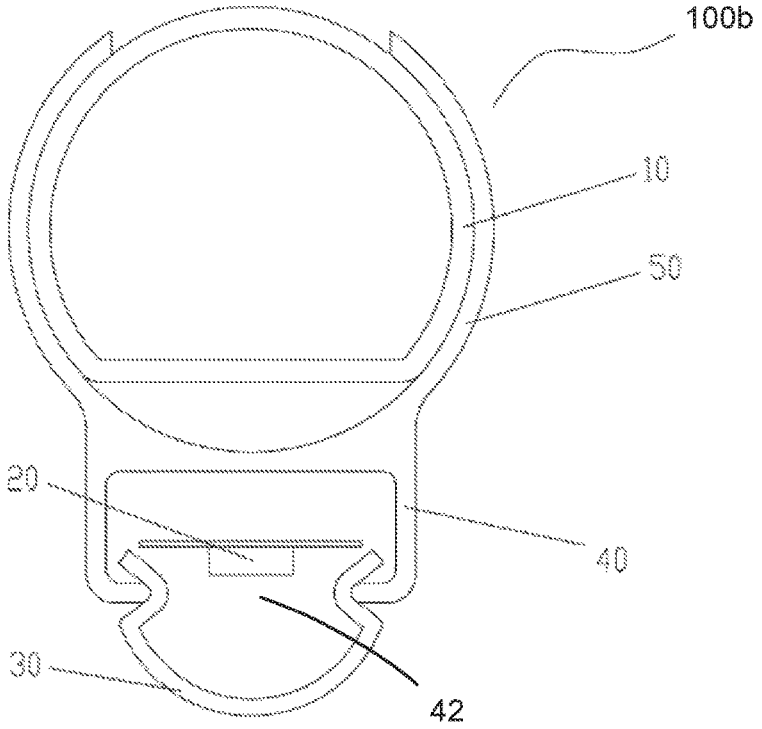
FIG. 3 is a schematic view illustrating a second exemplary illumination tent pole in accordance with some exemplary embodiments of the present invention.
Figure 4:
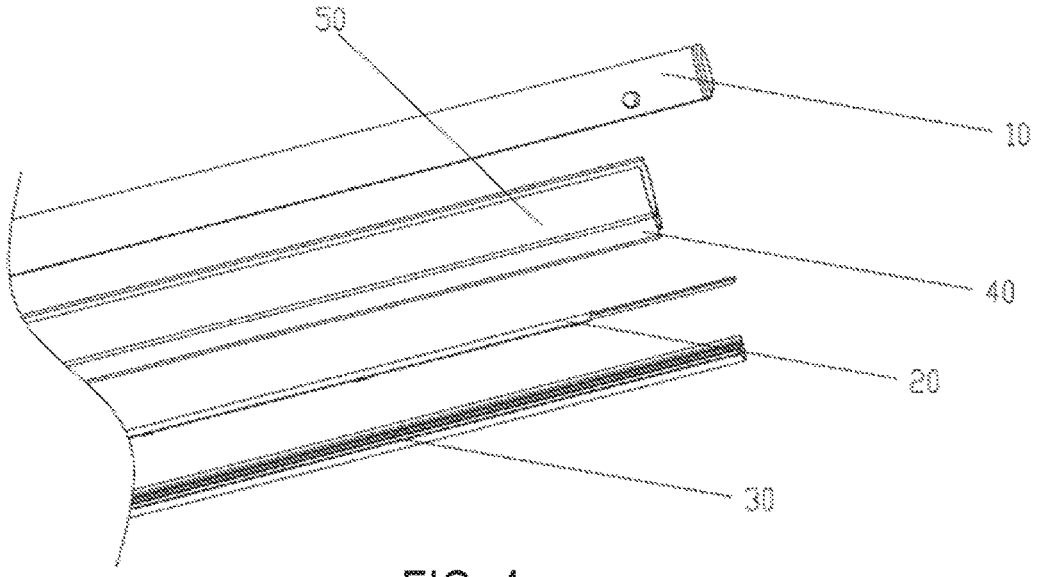
FIG. 4 is an exploded view illustrating the exemplary illumination tent pole of FIG. 3.

Referring to FIGS. 3 and 4, there is depicted a second exemplary illumination tent pole in accordance with some exemplary embodiments. Like illumination tent pole 100*a*, illumination tent pole 100*b* includes a tent pole such as tent pole 10, an elongated casing such as elongated casing 40, a light source such as strip light source 20. In some cases, illumination tent pole 100*b* further includes a cover such as cover 30. Unlike illumination tent pole 100*a*, elongated casing 40 of illumination tent pole 100*b* is not welded or bolted to tent pole 10. Instead, elongated casing 40 of illumination tent pole 100*b* is formed with a fitting such as fitting 50 to couple the elongated casing with the tent pole. In some exemplary embodiments, fitting 50 is formed opposite to the opening of the elongated casing, and is configured to be fitted onto the tent pole (e.g., can be snap-fitted or sleeved onto the tent pole). In an exemplary embodiment, the fitting is a C-shaped snap fit.

Figure 5A:
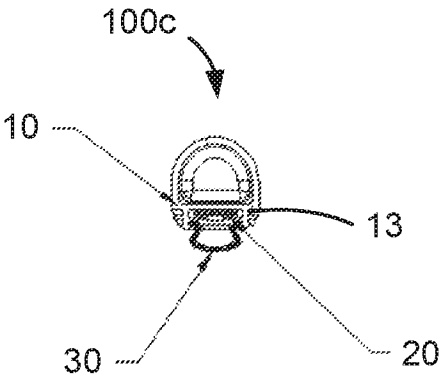
FIG. 5A is a schematic view illustrating a third exemplary illumination tent pole in accordance with some exemplary embodiments of the present invention.
Figure 5B:
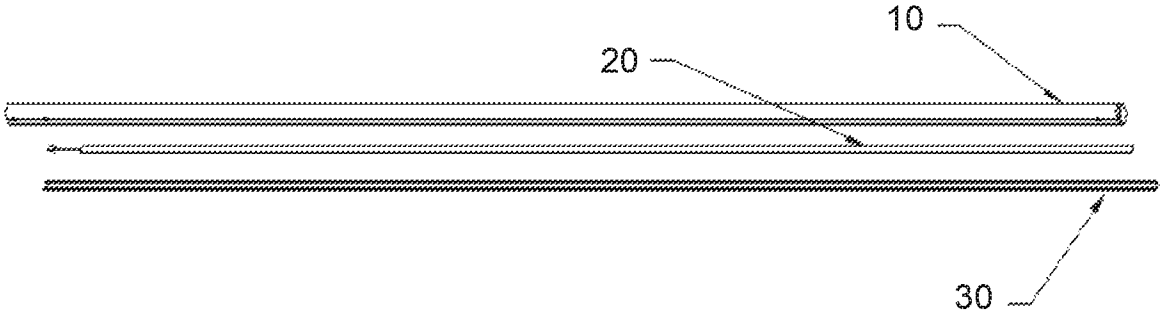
FIG. 5B is an exploded view illustrating the exemplary illumination tent pole of FIG. 5A.
Figure 5C:
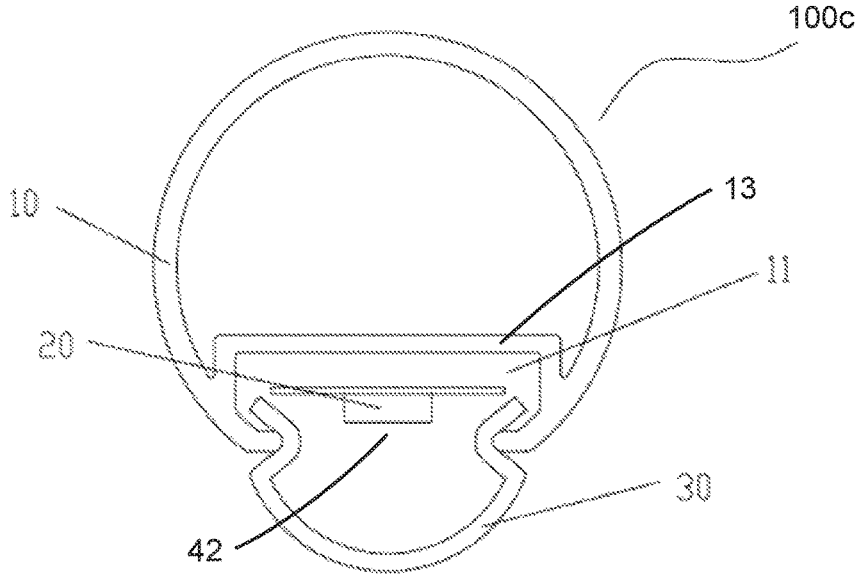
FIG. 5C is a schematic view illustrating an exemplary alternative illumination tent pole in accordance with some exemplary embodiments of the present invention.

Referring to FIGS. 5A, 5B and 5C, there is depicted a third exemplary illumination tent pole in accordance with some exemplary embodiments. Like illumination tent poles 100*a* and 100*b*, illumination tent pole 100*c* includes a tent pole such as tent pole 10 a light source such as strip light source 20, and in some cases, further includes a cover such as cover 30. Unlike illumination tent poles 100*a* and 100*b*, tent pole 10 of illumination tent pole 100*c* is formed with a receptacle such as receptacle 13 along a longitudinal direction of the tent pole. Receptacle 13 serves as the elongated casing and has a space such as space 11 to receive light source 20. In other words, elongated casing 40 (i.e., receptacle 13) of illumination tent pole 100*c* is integrally formed with the tent pole. In some exemplary embodiments such as those illustrated in FIG. 5C, receptacle 13 (i.e., elongated casing 40) is recessed inwardly into the tent pole with opening 42 facing an outside of the tent pole.

Figure 6:
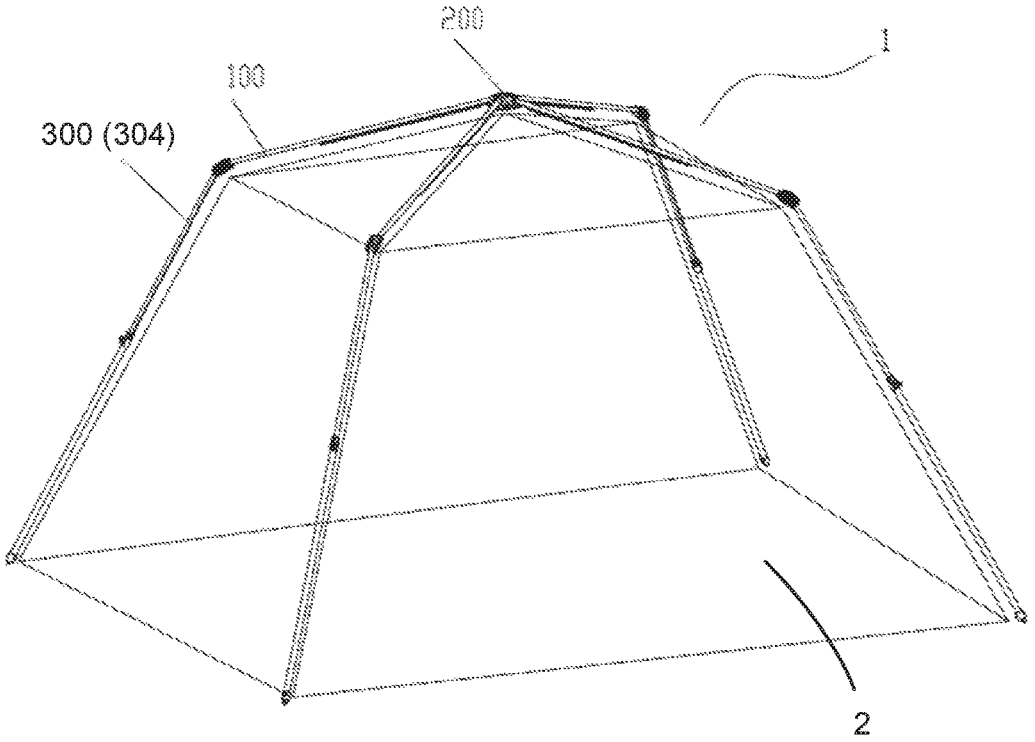
FIG. 6 is a schematic view illustrating an exemplary tent in an unfolded state in accordance with some exemplary embodiments of the present invention.
Figure 7:
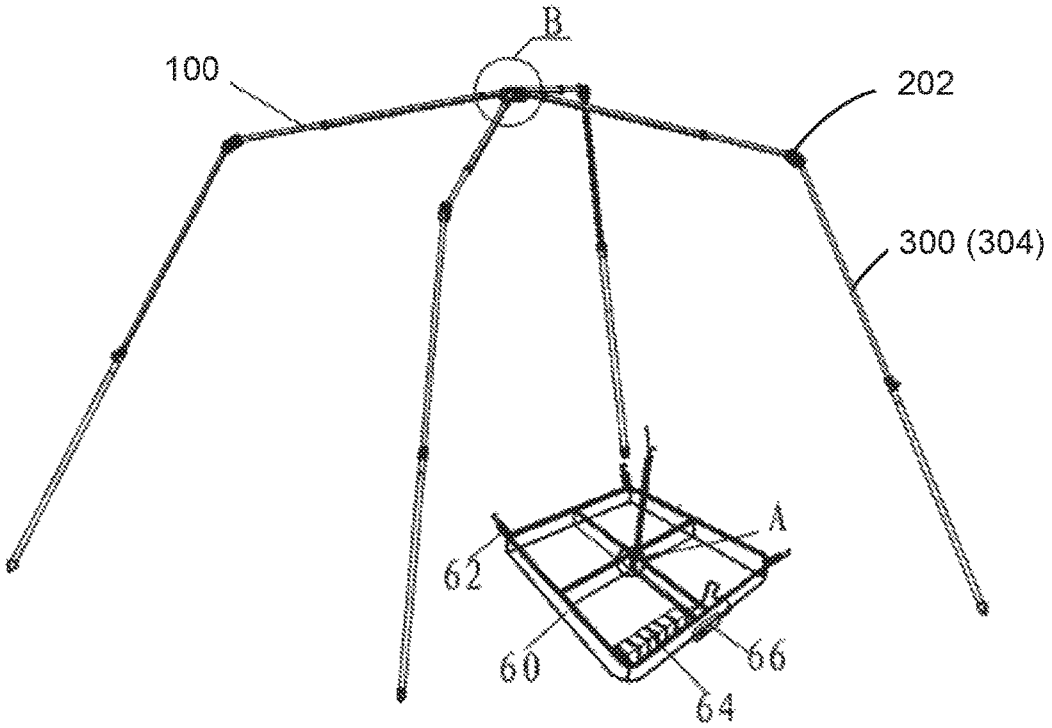
FIG. 7 is a schematic view illustrating an exemplary tent frame in an unfolded state in accordance with some exemplary embodiments of the present invention.
Figure 8:
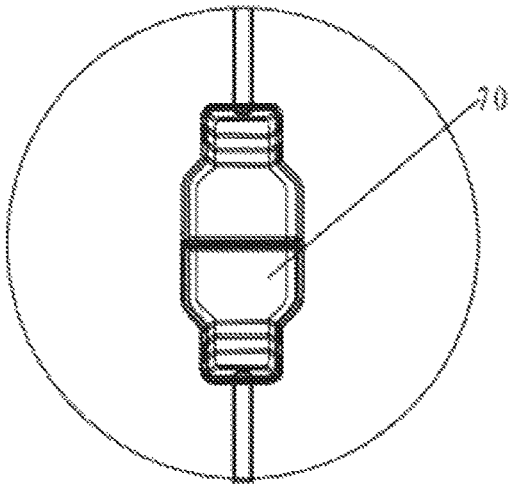
FIG. 8 is an enlarged view taken along circle A of FIG. 7.
Figure 9:
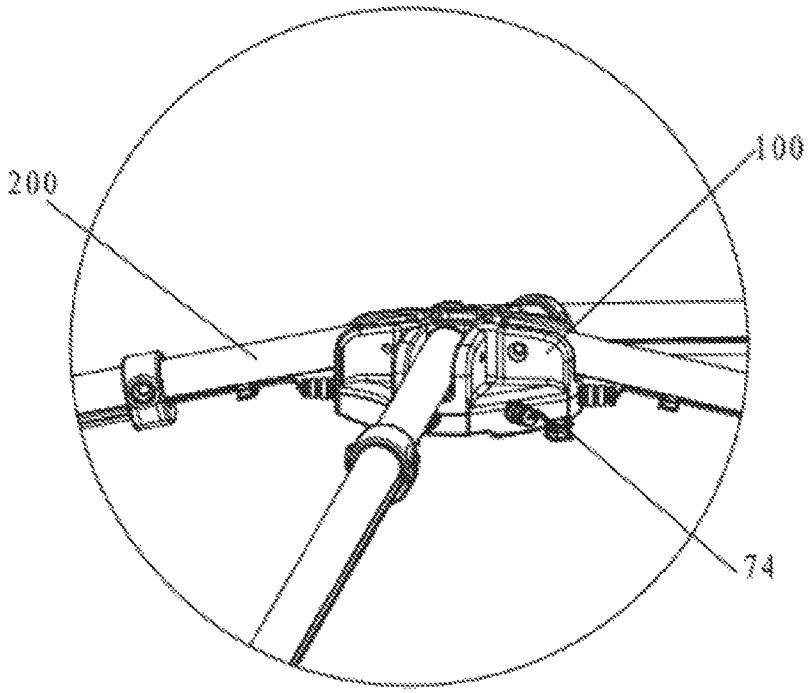
FIG. 9 is an enlarged view taken along circle B of FIG. 7.

Referring now to FIGS. 6 and 7, there are depicted an exemplary tent and an exemplary tent frame in accordance with some exemplary embodiments of the present invention. As shown, the tent includes a tent frame such as tent frame 1 and a tent cloth such as tent cloth 2. When unfolded, tent cloth 2 is coupled to and supported by tent frame 1.

In various exemplary embodiments, tent frame 1 includes a pole connector such as first pole connector 200 and a plurality of top poles such as top poles 100. Among the plurality of top poles 100, one or more top poles are configured to provide illumination. In other words, the plurality of top poles includes one or more illumination tent poles (e.g., 100*a*, 100*b*, and/or 100*c*). In some exemplary embodiments, each top pole 100 is an illumination tent pole.

In some exemplary embodiments, each illumination tent pole in the one or more illumination tent poles has substantially the same strip light source. In an exemplary embodiment, at least two illumination tent poles in the one or more illumination tent poles have different strip light sources (e.g., different in terms of types, colors of lights, number of LEDs, and/or lengths of the stripes).

The plurality of top poles 100 are pivotally connected to each other by first pole connector 200. In an exemplary embodiment, each top pole 100 has a first end portion (e.g., first end portion 12 of tent pole 10 in FIG. 2) and a second end portion, with the first end portion pivotally connected to the first pole connector.

Figure 13:
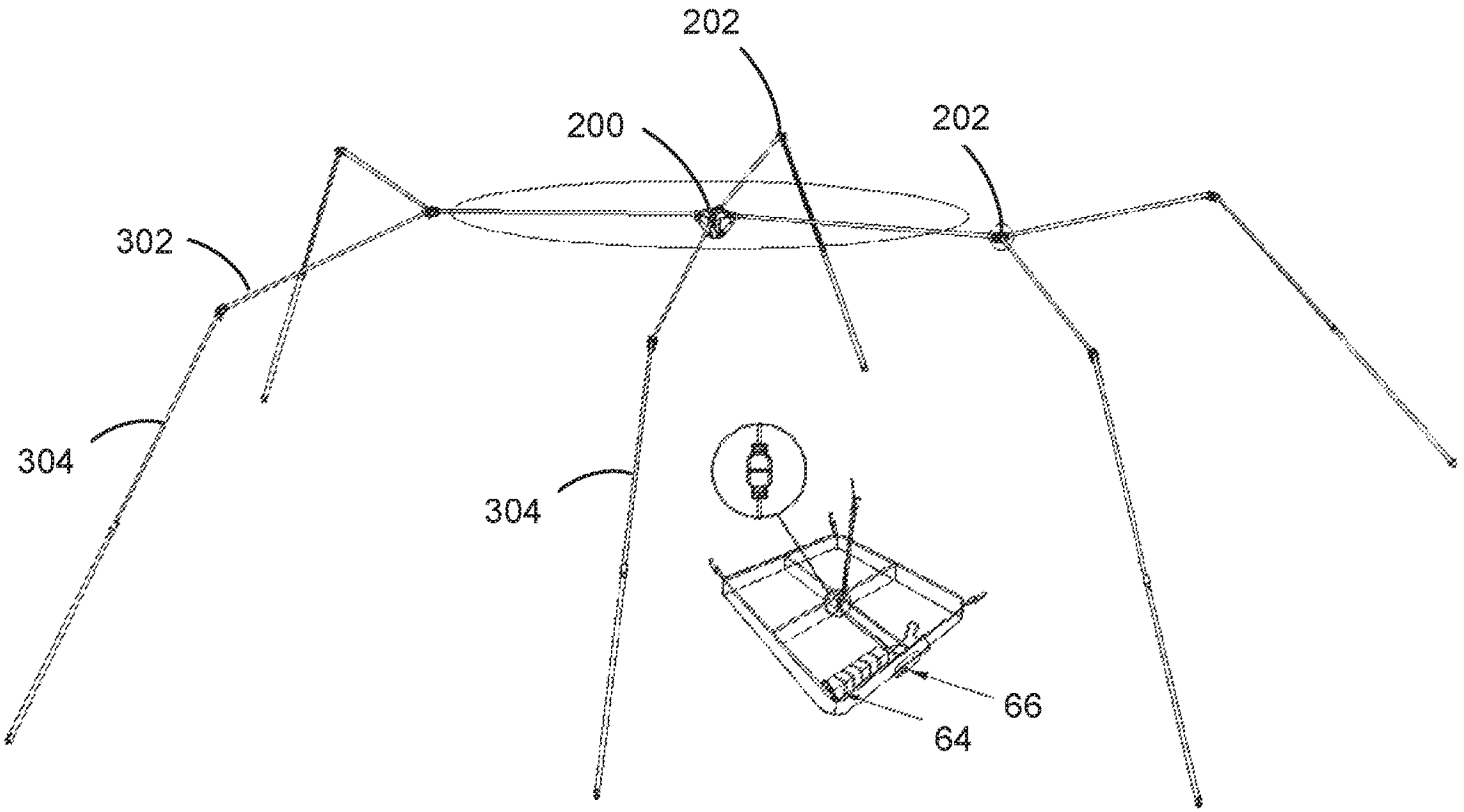
FIG. 13 is a schematic view illustrating an exemplary alternative tent frame in an unfolded state in accordance with some exemplary embodiments of the present invention.

Tent frame 1 also includes a plurality of supporting poles 300, each having a first end portion pivotally connected to the second end portion of a corresponding top pole 100. When unfolded, the supporting poles are disposed below and support the top poles. In some exemplary embodiments, tent frame 1 also includes a plurality of second pole connectors such as second pole connector 202. Each second pole connector is configured to pivotally connect the second end portion of one top pole in the plurality of top poles with one or more supporting poles in the plurality of supporting poles. As an example, FIG. 7 illustrates a tent frame with each respective top pole connected to one supporting pole, and vice versa. As another example, FIG. 13 illustrates a tent frame with at least one top pole connected to one supporting pole and at least one top pole connected to two supporting poles.

In some exemplary embodiments such as those illustrated in FIGS. 6 and 7, one or each supporting pole 300 in the plurality of supporting poles is telescopic, or has a length that is adjustable. In some exemplary embodiments such as those illustrated in FIG. 13, at least one supporting pole 300 in the plurality of supporting poles includes an upper supporting pole such as upper supporting pole 302 and a lower supporting pole such as lower supporting pole 304. Upper supporting pole 302 has first and second end portions, with the first end portion pivotally connected to the second end portion of a corresponding top pole in the plurality of top poles. Lower supporting pole 304 has a first end portion pivotally coupled to the second end portion of the upper supporting pole, and a second end portion to be disposed at a ground. In an exemplary embodiment, the lower supporting pole is telescopic, or has a length that is adjustable.

Referring to FIGS. 7-9 and 13, in some embodiments, the tent or the tent frame further includes a power source such as power source 64 to provide electrical power to one or more strip light sources. In an exemplary embodiment, power source 64 provides electrical power to the strip light source of each illumination tent pole in the one or more illumination tent poles. Suitable power sources include but are not limited to batteries and mobile power banks.

In some embodiments, the tent or the tent frame also includes a first electrical connector such as first electrical connector 70. First electrical connector 70 is configured to electrically connect the one or more strip light sources, or the strip light source of each illumination tent pole in the one or more illumination tent poles with the power source. The first electrical connector can be a plug, a socket, a wiring block or the like.

Figure 10:
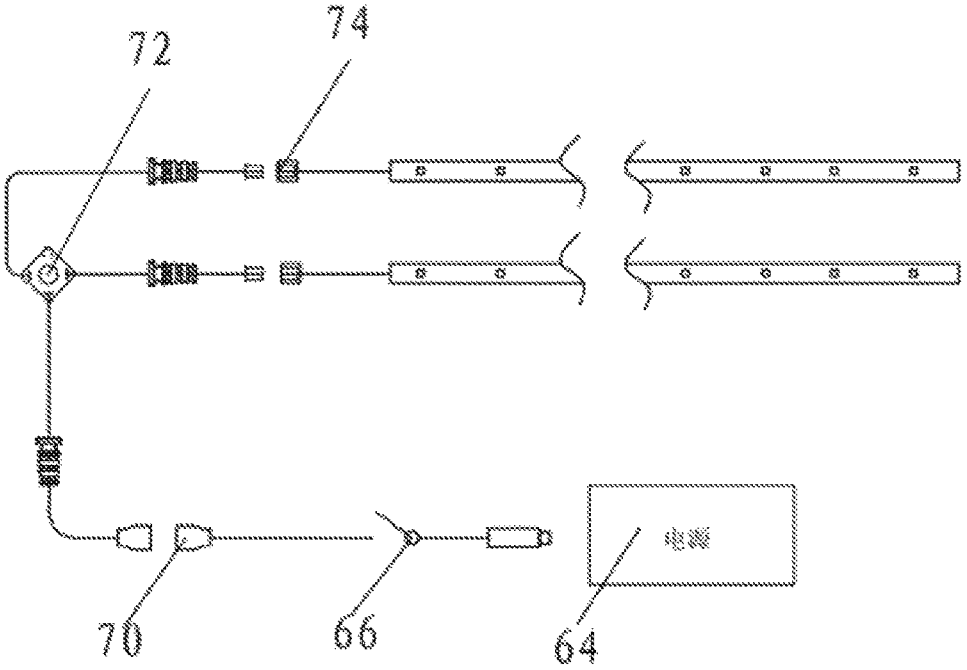
FIG. 10, FIG. 11 and FIG. 12 are schematic diagrams illustrating electrical connections of light sources with a power source.
Figure 11:
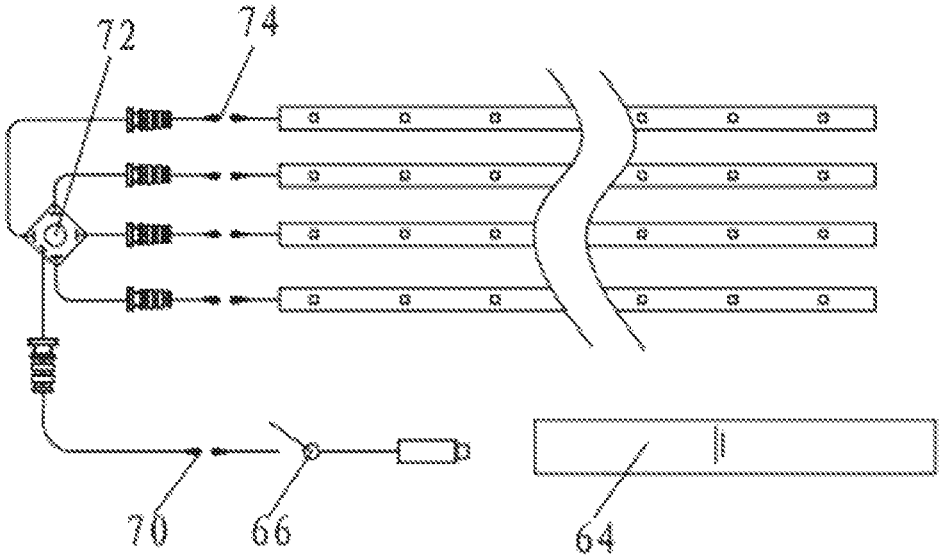
Figure 12:
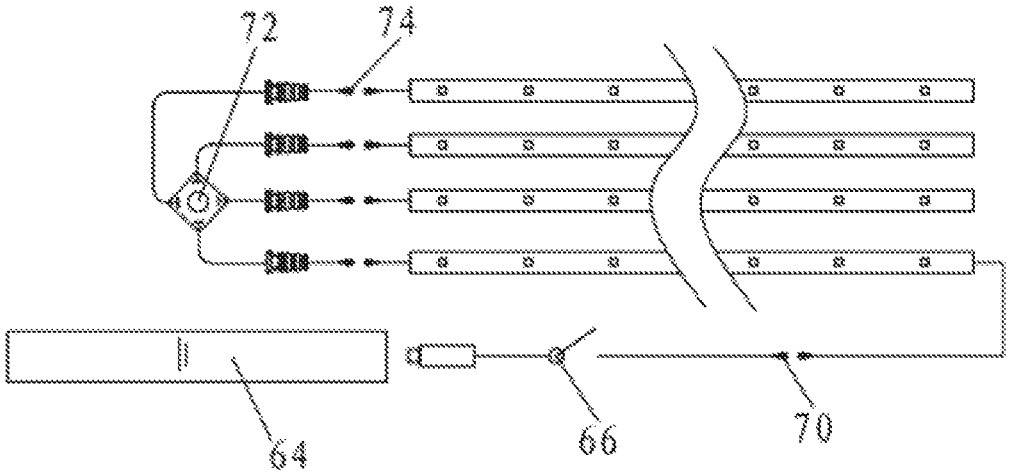

In some exemplary embodiments, the tent or the tent frame includes a circuit board such as circuit board 72 disposed at first pole connector 200. In an exemplary embodiment, the circuit board is coupled to the bottom of the first pole connector. Circuit board 72 includes one or more second electrical connectors such as second electrical connector 74 electrically connected to the first electrical connector or the power source. The second electrical connector can be a plug, a socket, a wiring block or the like. As illustrated in FIGS. 10 and 11, each of the one or more strip light sources is electrically connected to power source 64 through second electrical connector 74 of second circuit board 72 and first connector 70. In an exemplary embodiment such as that illustrated in FIG. 12, one or more stripe light sources are electrically connected to the power source through the first electrical connector.

In some exemplary embodiments, the tent or the tent frame further includes a switch such as switch 66. Switch 66 is disposed electrically between the power source and the first electrical connector, i.e., having a first terminal electrically connected to the power source and a second terminal electrically connected to the first electrical connector. Switch 66 can be turn on or off, thereby controlling the electrical power supplied to the strip light source of each illumination tent pole in the one or more illumination tent poles.

In some exemplary embodiments, the tent or the tent frame further includes a storage compartment such as storage compartment 60 to house the power source, the first electrical connector and/or the switch. Storage compartment 60 can be a case, a basket, a box or the like. Storage compartment 60 is to be coupled to the tent cloth, the tent frame, or both of the tent cloth and the tent frame, for example, by one or more hooks 62.

As disclosed herein, the tent frames and tents of the present invention includes one or more illumination tent poles to provide illumination when desired. The illumination tent pole is configured in such a way (e.g., with the illumination source in the tent pole) that it does not affect the overall appearance and setup of the tent frames and the tents. In some cases, the illumination is to be powered by a battery or a mobile power bank included in the tent frame or the tent, making the use of the tents more convenient and flexible.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "upper" or "lower", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first pole connector could be termed a second pole connector, and, similarly, a second pole connector could be termed a first pole connector, without changing the meaning of the description, so long as all occurrences of the "first pole connector" are renamed consistently and all occurrences of the "second pole connector" are renamed consistently.

What is claimed is:

1. An illumination tent pole comprising:

a tent pole comprising a substantially flat lower surface;

an elongated casing comprising a substantially flat upper surface and an opening along a longitudinal direction of the elongated casing, wherein the substantially flat upper surface of the elongated casing is attached to the substantially flat upper surface of the tent pole, thereby coupling the elongated casing with the tent pole, and wherein the opening faces away from the tent pole;

a strip light source disposed along the elongated casing, the strip light source emitting a light when electrically connected to an electrical power source; and a cover coupled to the elongated casing and covering the opening of the elongated casing, the cover made of a material that is at least partially transparent to the light emitted by the strip light source, wherein the strip light source is disposed between the elongated casing and the cover, and surrounded by the elongated casing and the cover.

2. The illumination tent pole of claim 1, wherein the strip light source is a light emitting diode (LED) strip, an LED tape, or an LED ribbon.

3. The illumination tent pole of claim 1, wherein the elongated casing has a substantially C-shape cross section.

4. A tent frame comprising:

a first pole connector;

a plurality of top poles, each having a first end portion and a second end portion, the first end portion pivotally connected to the first pole connector, wherein the plurality of top poles comprises one or more illumination tent poles of claim 1;

and a plurality of supporting poles, each having a first end portion pivotally connected to the second end portion of a corresponding top pole in the plurality of top poles.

5. The tent frame of claim 4, wherein each top pole in the plurality of top poles is an illumination tent pole.

6. The tent frame of claim 4, wherein the strip light source of each illumination tent pole in the one or more illumination tent poles is a light emitting diode (LED) strip, an LED tape, or an LED ribbon.

7. The tent frame of claim 4, wherein each top pole in the plurality of tent poles is pivotally connected to one or more supporting poles in the plurality of supporting poles.

8. The tent frame of claim 4, further comprising:

a plurality of second pole connectors, each pivotally connecting the second end portion of one top pole in the plurality of top poles with one or more supporting poles in the plurality of supporting poles.

9. The tent frame of claim 4, wherein each of one or more supporting poles in the plurality of supporting poles is telescopic, or has a length that is adjustable.

10. The tent frame of claim 4, wherein each of one or more supporting poles in the plurality of supporting poles comprises:

an upper supporting pole having first and second end portions, the first end portion thereof pivotally connected to the second end portion of a corresponding top pole in the plurality of top poles; and a lower supporting pole having a first end portion pivotally coupled to the second end portion of the upper supporting pole, and a second end portion to be disposed at a ground.

11. The tent frame of claim 10, wherein the lower supporting pole is telescopic, or has a length that is adjustable.

12. The tent frame of claim 4, further comprising:

a power source to supply electrical power to the strip light source of each illumination tent pole in the one or more illumination tent poles; and a first electrical connector to electrically connect the strip light source of each illumination tent pole in the one or more illumination tent poles with the power source.

13. The tent frame of claim 12, further comprising:

a switch to control the electrical power supplied to the strip light source of each illumination tent pole in the one or more illumination tent poles, the switch having a first terminal electrically connected to the power source and a second terminal electrically connected to the first electrical connector.

14. The tent frame of claim 12, further comprising:

a storage compartment to house the power source, the first electrical connector and the switch, wherein the storage compartment is configured to be coupled to a tent cloth, the tent frame, or both of the tent cloth and the tent frame.

15. The tent frame of claim 12, further comprising:

a board disposed at the first pole connector and comprising one or more second electrical connectors electrically connected to the first electrical connector or the power source, wherein the strip light source of a respective illumination pole in the one or more illumination tent poles is electrically connected to a corresponding second electrical connector in the one or more second electrical connector.

16. The tent frame of claim 15, wherein the board is coupled to a bottom of the first pole connector.

17. A tent comprising:

the tent frame of claim 4;

a tent cloth coupled to and supported by the tent frame when the tent is unfolded.

18. An illumination tent pole comprising:

a tent pole comprising a peripheral wall and a receptacle formed with the peripheral wall, wherein the receptacle is formed along a longitudinal direction of the tent pole and has an opening facing an outside of the tent pole, wherein the receptacle forms an elongated casing;

a strip light source disposed along the elongated casing, the strip light source emitting a light when electrically connected to an electrical power source; and a cover coupled to the elongated casing and covering the opening of the elongated casing, the cover made of a material that is at least partially transparent to the light emitted by the strip light source, wherein the strip light source is disposed between the elongated casing and the cover, and surrounded by the elongated casing and the cover.

19. The illumination tent pole of claim 18, wherein the receptacle is recessed inwardly into the tent pole with the opening facing an outside of the tent pole.

20. A tent frame comprising:

a first pole connector;

a plurality of top poles, each having a first end portion and a second end portion, the first end portion pivotally connected to the first pole connector, wherein the plurality of top poles comprises one or more illumination tent poles of claim 18; and a plurality of supporting poles, each having a first end portion pivotally connected to the second end portion of a corresponding top pole in the plurality of top poles.

21. The tent frame of claim 20, wherein each top pole in the plurality of top poles is an illumination tent pole.

22. The tent frame of claim 20, wherein the strip light source of each illumination tent pole in the one or more illumination tent poles is a light emitting diode (LED) strip, an LED tape, or an LED ribbon.

23. The tent frame of claim 20, wherein each top pole in the plurality of tent poles is pivotally connected to one or more supporting poles in the plurality of supporting poles.

24. The tent frame of claim 20, further comprising:

a plurality of second pole connectors, each pivotally connecting the second end portion of one top pole in the plurality of top poles with one or more supporting poles in the plurality of supporting poles.

25. The tent frame of claim 20, wherein each of one or more supporting poles in the plurality of supporting poles is telescopic, or has a length that is adjustable.

26. The tent frame of claim 20, wherein each of one or more supporting poles in the plurality of supporting poles comprises:

an upper supporting pole having first and second end portions, the first end portion thereof pivotally connected to the second end portion of a corresponding top pole in the plurality of top poles; and a lower supporting pole having a first end portion pivotally coupled to the second end portion of the upper supporting pole, and a second end portion to be disposed at a ground.

27. The tent frame of claim 20, further comprising:

a power source to supply electrical power to the strip light source of each illumination tent pole in the one or more illumination tent poles; and a first electrical connector to electrically connect the strip light source of each illumination tent pole in the one or more illumination tent poles with the power source.

28. The tent frame of claim 27, further comprising:

a storage compartment to house the power source, the first electrical connector and the switch, wherein the storage compartment is configured to be coupled to a tent cloth, the tent frame, or both of the tent cloth and the tent frame.

* * * * *